US009814309B2

(12) United States Patent
Kim

(10) Patent No.: US 9,814,309 B2
(45) Date of Patent: Nov. 14, 2017

(54) LIFT TABLE FOR COMPUTER

(71) Applicant: Seung Ho Kim, Gyeonggi-do (KR)

(72) Inventor: Seung Ho Kim, Gyeonggi-do (KR)

( * ) Notice: Subject to any disclaimer, the term of this patent is extended or adjusted under 35 U.S.C. 154(b) by 0 days.

(21) Appl. No.: 15/096,567

(22) Filed: Apr. 12, 2016

(65) Prior Publication Data

US 2017/0049224 A1 Feb. 23, 2017

(30) Foreign Application Priority Data

Aug. 18, 2015 (KR) ..... 10-2015-0015882
Aug. 18, 2015 (KR) ..... 10-2015-0115890

(51) Int. Cl.

*A47B 21/00* (2006.01)
*A47B 21/02* (2006.01)
*A47B 9/02* (2006.01)
*A47B 9/18* (2006.01)

(Continued)

(52) U.S. Cl.

CPC ..... *A47B 21/02* (2013.01); *A47B 9/02* (2013.01); *A47B 9/18* (2013.01); *A47B 21/04* (2013.01); *A47B 9/16* (2013.01); *A47B 2009/185* (2013.01); *A47B 2200/0041* (2013.01); *A47B 2200/0085* (2013.01)

(58) Field of Classification Search

CPC ..... Y10T 403/39; Y10T 403/3906; Y10T 403/3913; Y10T 403/4602; Y10T 403/4605; Y10T 403/4642; A47B 1/056; A47B 1/04; A47B 1/02; A47B 3/12; A47B 3/06; A47B 87/002; A47B 12/088; F16M 11/24; F16M 11/2014; F16M 11/2092; F16M 2200/004; F16M 2200/063

USPC ..... 108/145, 144.11, 147, 93, 96, 116–118, 108/120, 43, 138, 50.01, 50.02, 14, 13, 108/11, 4, 9, 10, 33, 39; 312/208.1, 312/223.3, 306, 312; 248/421, 562, 588, 248/585, 431, 432, 439, 280.11, 292.11, 248/919, 920, 923

See application file for complete search history.

(56) References Cited

U.S. PATENT DOCUMENTS 2,903,316 A * 9/1959 Schmidt ..... B25H 1/12 312/140.4
3,417,953 A * 12/1968 Hillquist ..... B01L 9/00 248/284.1

(Continued)

FOREIGN PATENT DOCUMENTS

EP 2842458 * 3/2015
EP 3132710 * 2/2017

(Continued)

*Primary Examiner* — Janet M Wilkens

(74) *Attorney, Agent, or Firm* — KORUS Patent, LLC; Seong Il Jeong

(57) ABSTRACT

A position-adjustable lift table is provided. The lift table comprises an upper plate, a lower plate, a lift assembly provided between the upper plate and the lower plate and including an upper frame hinged to the upper plate, a lower frame hinged to the lower plate, and a driving arm assembly. The driving arm assembly includes two upper arms connected with each other via a first elastic body, two lower arms connected with each other via a second elastic body, the upper arms being hinged to the lower arms. A locking device is provided at an end of the driving arm assembly to secure a folded or unfolded position of the driving arm assembly.

10 Claims, 26 Drawing Sheets

(51) Int. Cl.
*A47B 21/04* (2006.01)
*A47B 9/16* (2006.01)

(56) References Cited

U.S. PATENT DOCUMENTS

| | | | | | |
|---|---|---|---|---|---|
| 4,953,822 | A * | 9/1990 | Sharber | F16M 11/2014 | 248/280.11 |
| 5,180,136 | A * | 1/1993 | Sova | A47B 21/0314 | 248/284.1 |
| 5,501,420 | A * | 3/1996 | Watt | A47B 21/0073 | 248/280.11 |
| 5,676,424 | A * | 10/1997 | Winkelhake | B60N 2/1803 | 248/421 |
| 5,857,415 | A * | 1/1999 | Richard | A47B 21/0073 | 108/10 |
| 6,029,585 | A * | 2/2000 | Tabayashi | B66F 7/0625 | 108/145 |
| 6,502,261 | B1 * | 1/2003 | Harwood | A61B 6/0457 | 108/145 |
| 7,222,832 | B2 * | 5/2007 | Welker | A47C 3/38 | 248/157 |
| 7,641,294 | B1 * | 1/2010 | Goldberg | A47B 17/033 | 312/196 |
| 2006/0054751 | A1 * | 3/2006 | Johnson | A47B 9/00 | 248/123.11 |
| 2012/0119040 | A1 | 5/2012 | Ergun et al. | | |

FOREIGN PATENT DOCUMENTS

| | | | |
|---|---|---|---|
| JP | H06-038833 | A | 2/1994 |
| KR | 20-2014-0004886 | U | 9/2014 |

* cited by examiner

Prior Art

Prior Art

LIFT TABLE FOR COMPUTER

CROSS-REFERENCE TO RELATED APPLICATIONS

This patent application claims priority under 35 U.S.C. §119 to Korean Patent Applications Nos. 10-2015-0115882 and 10-2015-0115890, filed an Aug. 18, 2015, in the Korean Intellectual Property Office, the disclosures of which are incorporated by reference herein in their entireties.

TECHNICAL FIELD

Embodiments of the present invention concern tables for computers or other purposes, and more specifically, to position-adjustable tables.

DISCUSSION OF RELATED ART

Various types of computer tables or desks come to the market. They are designed typically considering work while the user sits on chair. For health or other various reasons or purposes, more interest is attracted to desks, tables, or workstations allowing the user to work while standing or position-adjustable ones.

Examples of some relevant products are shown in FIGS. 1*a* and 1*b*. Such conventional computer tables or desks including the ones illustrated typically take up ample space, difficult to use, and do not live up to the users in terms of design. Thus, a need exists for a better mechanism that may provide an enhanced aesthetical look and efficient use of space while remaining simple in use or positioning.

SUMMARY

According to an embodiment of the present invention, a lift table comprises an upper plate, a lower plate, a lift assembly provided between the upper plate and the lower plate arid including an upper frame hinged to the upper plate, a lower frame hinged to the lower plate, and a driving arm assembly. The driving arm assembly may include two upper arms connected with each other via a first elastic body, two lower arms connected with each other via a second elastic body, the upper arms hinged to the lower arms, and a locking device provided at an end of the driving arm assembly to secure a folded or unfolded position of the driving arm assembly.

The upper table may include a main body shaped as a flat plate and one or more assistant plates connected with the main body and spaced apart from the main body at a predetermined distance.

The lift table may further comprise a receiver protruding on the upper plate and having an inner hollow space where the lift assembly and the locking device are received while the lift assembly is in a folded position.

The receiver may include an opening through which the locking device can be manipulated.

The driving arm assembly may further include an arm joint. The two upper arms are disposed parallel with each other, and the respective first ends of the two upper arms are hinged to the upper frame, and the respective second ends of the two upper arms are hinged to the arm joint. The two lower arms are disposed parallel with each other, and the respective first ends of the two lower arms are hinged to the arm joint, and the respective second ends of the two lower arms are hinged to the lower frame.

The first elastic body may provide an elastic force to the two upper arms in a direction along which the driving arm assembly is unfolded, and the second elastic body may provide an elastic force to the two lower arms in the direction.

A first upper arm of the two upper arms may include a first locking gear at the first end thereof.

The locking device may include a locking latch, the locking latch including a second locking gear corresponding to the first locking gear and a locking hinge hinged to a side surface of the upper frame to create a rotational movement allowing the first locking gear and the second locking gear to be engaged or disengaged from each other, a locking elastic body applying an elastic force to the locking latch in a direction along which the first locking gear and the second locking gear are engaged with each other, a bar-shaped locking driving arm having a first end hinged to a side surface of the locking latch to space the first locking gear apart from the second locking gear when an external device is applied to a second end of the locking driving arm, and a locking lever allowing the external force to be manually applied to the second end of the locking driving arm.

The first upper arm may include an upper joint gear at the second end thereof, and a first lower arm of the two lower arms may include a lower joint gear at the first end of thereof, the lower joint gear corresponding to the upper joint gear.

The first lower arm may include an elasticity adjusting lever hinged to the first end of the first lower arm and rotated at a predetermined angle to change a position where the second elastic body is connected to the first lower arm.

At least one of the first elastic body or the second elastic body may include a spring.

BRIEF DESCRIPTION OF THE DRAWINGS

A more complete appreciation of the present disclosure and many of the attendant aspects thereof will be readily obtained as the same becomes better understood by reference to the following detailed description when considered in connection with the accompanying drawings, wherein.

DETAILED DESCRIPTION OF EXEMPLARY EMBODIMENTS

Figure 1A:
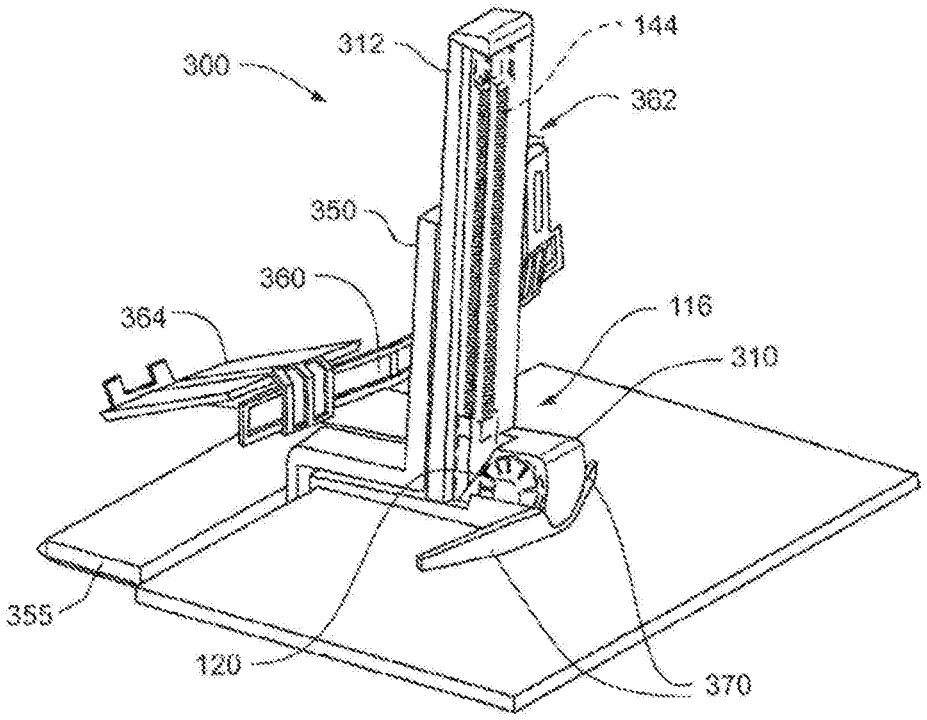
FIG. 1*a* is a perspective view illustrating a computer table when used in a sitting position according to a related art.
Figure 1B:
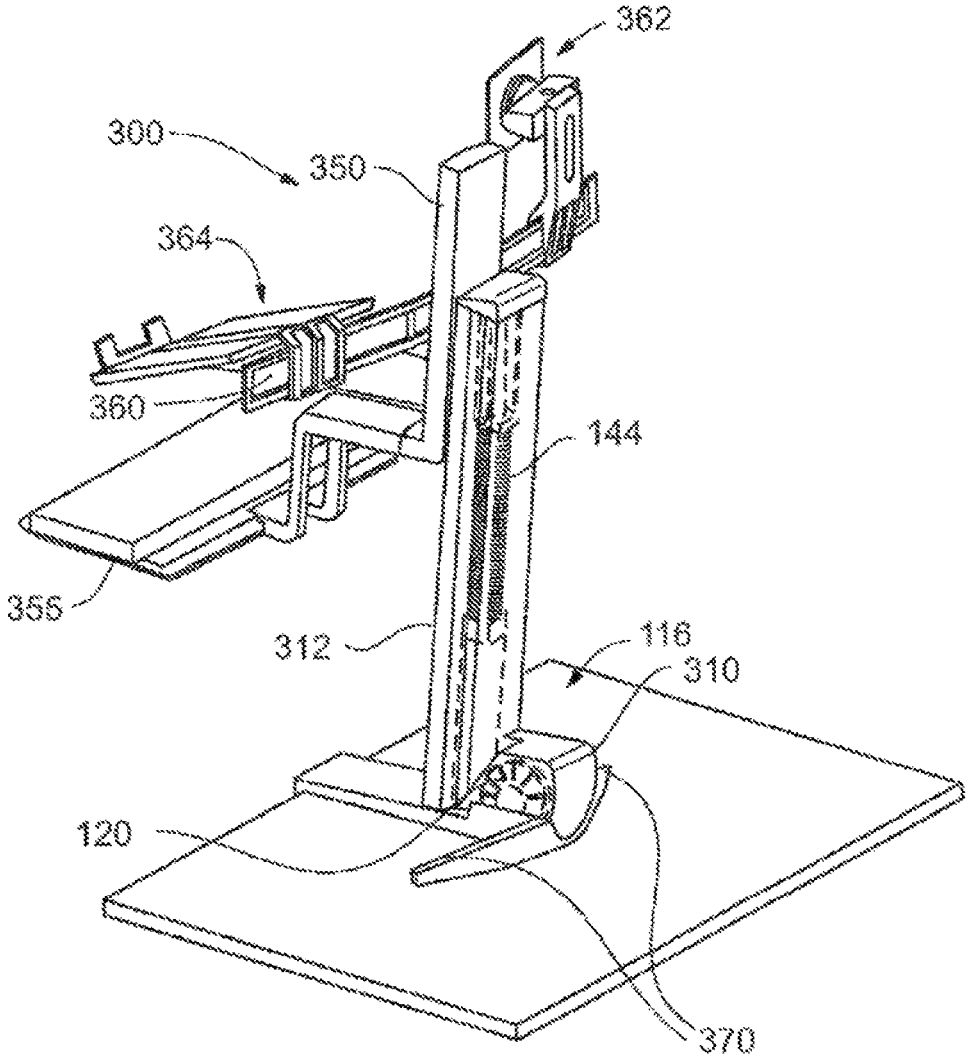
FIG. 1*b* is a perspective view illustrating a computer table when used in a standing position according to a related art.

Hereinafter, exemplary embodiments of the inventive concept will be described, in detail with reference to the accompanying drawings. The inventive concept, however, may be modified in various different ways, and should not be construed as limited to the embodiments set forth herein. As used herein, the singular forms "a," "an," and "the" are intended to include the plural forms as well, unless the context clearly indicates otherwise. It will be understood that when an element or layer is referred to as being "on," "connected to," "coupled to," or "adjacent to" another element or layer, it can be directly on, connected, coupled, or adjacent to the other element or layer, or intervening elements or layers may be present. The same reference numerals may denote the same or similar elements throughout the specification and the drawings.

Figure 2A:
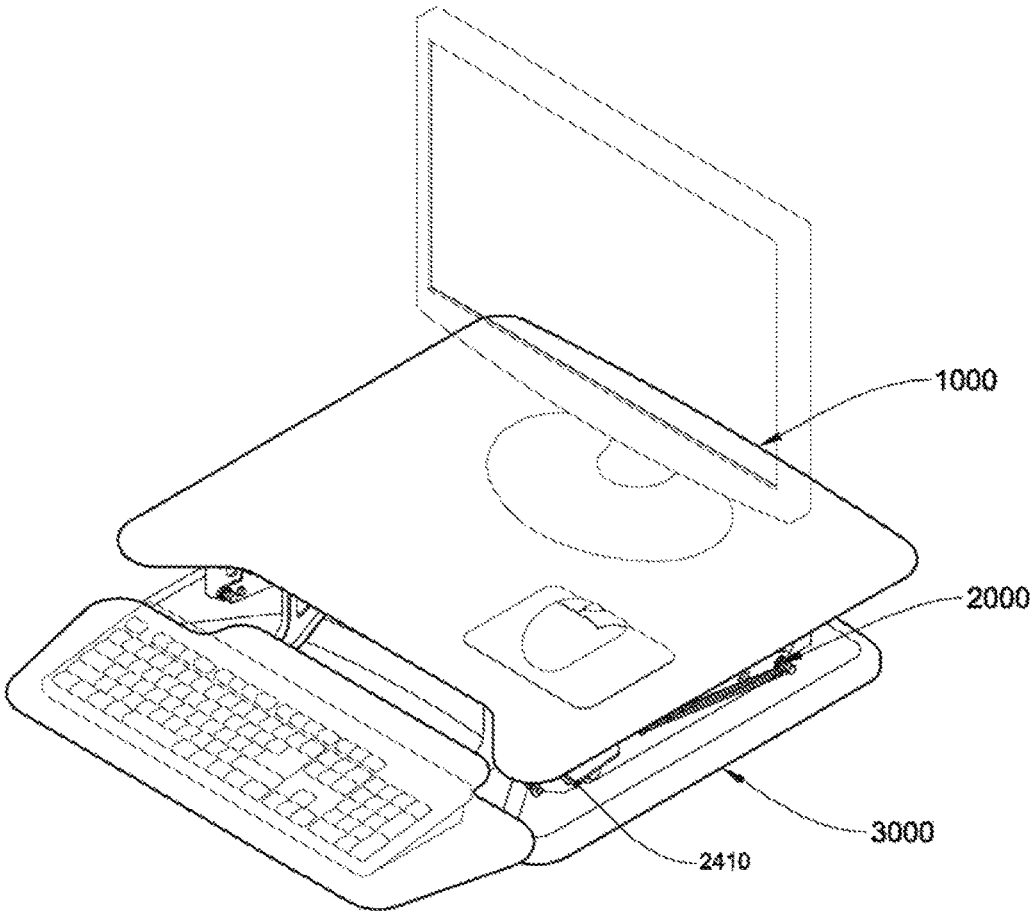
FIG. 2*a* is a perspective view illustrating a lift table in a folded position according to an embodiment of the present invention.
Figure 2B:
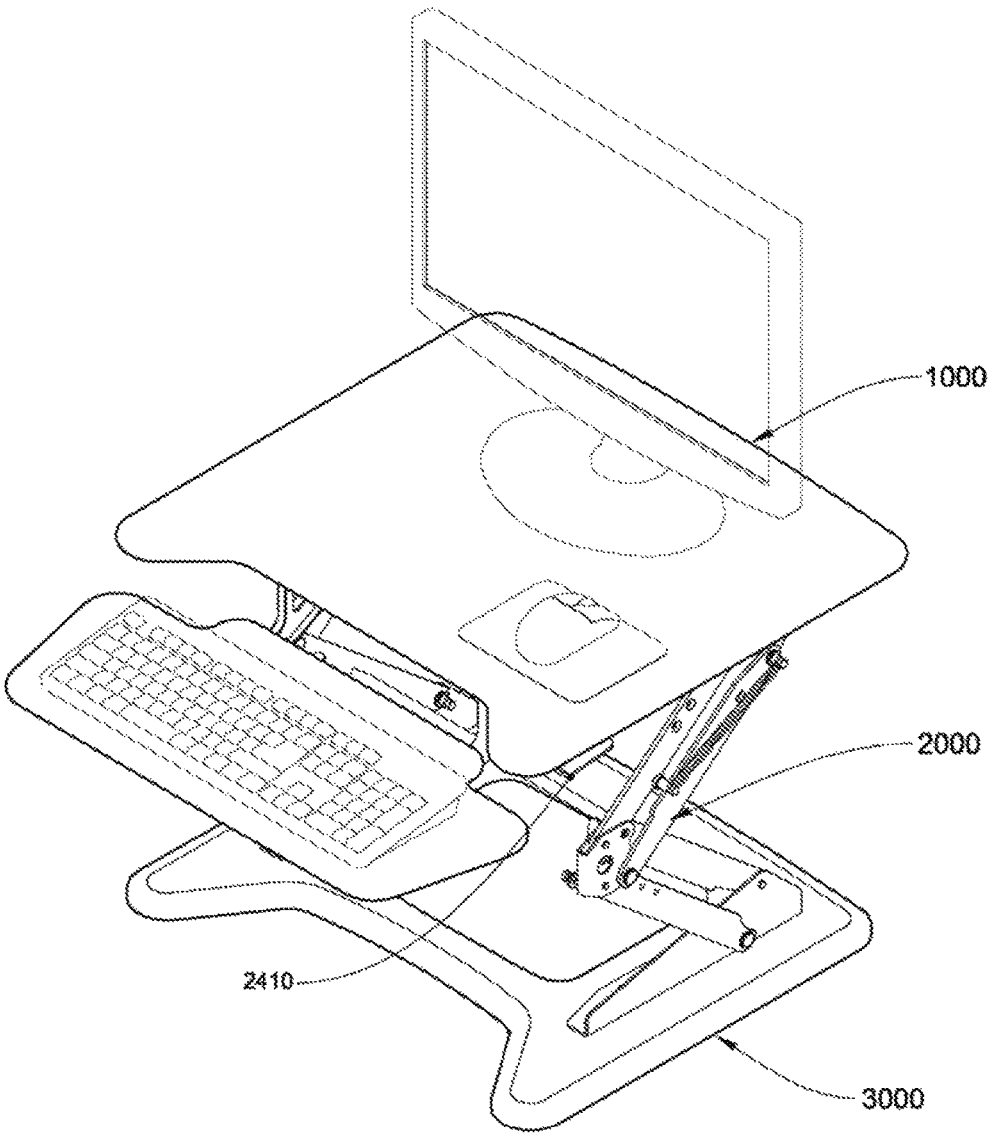
FIG. 2*b* is a perspective view illustrating a lift table in an unfolded position according to an embodiment of the present invention.
Figure 2C:
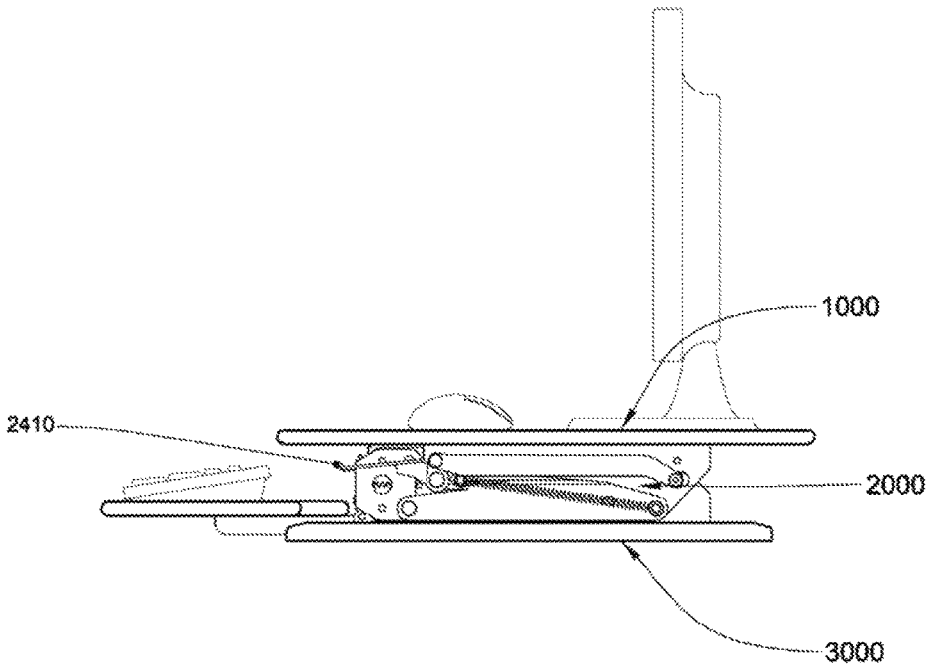
FIG. 2*c* is a side view illustrating a lift table in a folded position according to an embodiment of the present invention.
Figure 2D:
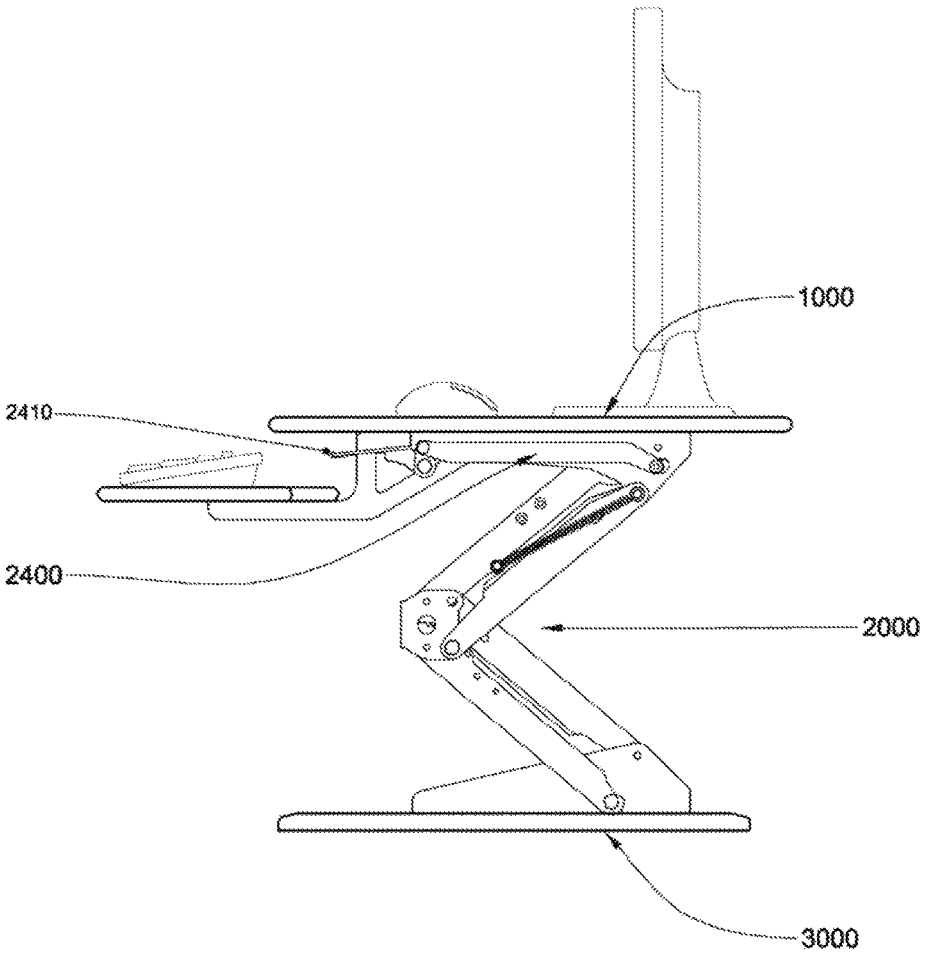
FIG. 2*d* is a side view illustrating a lift table in an unfolded position according to an embodiment of the present invention.

FIG. 2*a* is a perspective view illustrating a lift table in a folded position according to an embodiment of the present invention. FIG. 2*b* is a perspective view illustrating a lift table in an unfolded position according to an embodiment of the present invention. FIG. 2*c* is a side view illustrating a lift table in a folded position according to an embodiment of the present invention. FIG. 2*d* is a side view illustrating a lift table in an unfolded position according to an embodiment of the present invention.

Referring to FIGS. 2*a* to 2*d*, according to an embodiment of the present invention, the lift table includes an upper table 1000, a lift assembly 2000, a locking device 2400, and a lower plate 3000.

The upper plate 1000 allows an object to be placed thereon and is shaped as a flat plate. The lift assembly 2000 includes a plurality of bars hinged to each other and one or more elastic bodies exerting an elastic force in a direction along which the lift assembly 2000, or specifically the bars of the lift assembly 2000, are unfolded or expanded. For example, the lift assembly 2000 may be folded, or the lift assembly 2000 may be elastically unfolded, expanded, or stretched. The locking device 2400 includes a structure to be stuck to an end of the lift assembly 2000 to secure a folded position or unfolded position of the lift assembly 2000. The locking device 2400 may include a locking lever 2410 that is manipulated to allow the lift assembly 2000 to be locked or unlocked to secure the position of the lift assembly or to release the secured position of the lift assembly. The lower plate 3000 supports the lift assembly 2000 and transfer's the load to the surface, ground, or floor on which the lift table is placed. The elastic body may be a spring, but not limited thereto.

A computer or other peripheral devices, such as a monitor, keyboard or mouse, may be placed on the lift table, specifically, the upper plate 1000 of the lift table. In the folded position of the lift assembly 2000, the user may use the computer or peripheral devices in a sitting position, and in the unfolded position of the lift assembly 2000, the user may use them in a standing position.

As such, the lift table allows the user to use the computer or peripheral devices regardless of whether he/she stands or sits.

When the locking lever 2410 is manipulated while the lift table is in the folded position, the lift assembly 2000 is elastically unfolded or stretched by the elastic bodies, and thus, the lift table changes its position to be used while the user is in the standing positions. When the upper plate 1000 is pushed down while the locking lever 2410 remains manipulated, the lift assembly 2000 is folded, and thus, the lift table changes its position to be used in the sitting position of the user.

Figure 3A:
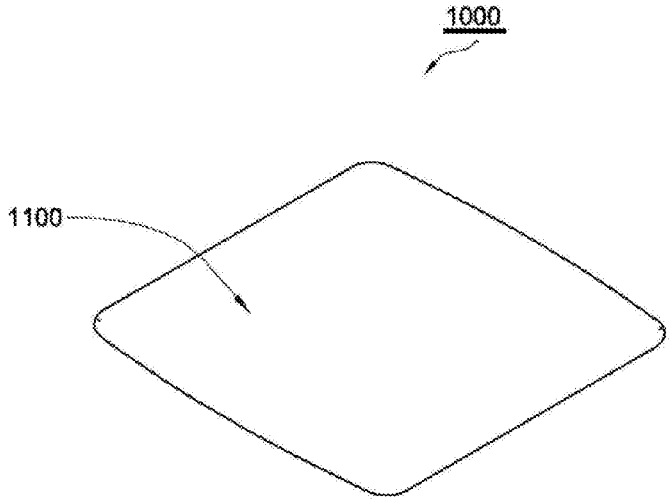
FIG. 3*a* is a perspective view illustrating an upper plate of a lift table according to an embodiment of the present invention.
Figure 3B:
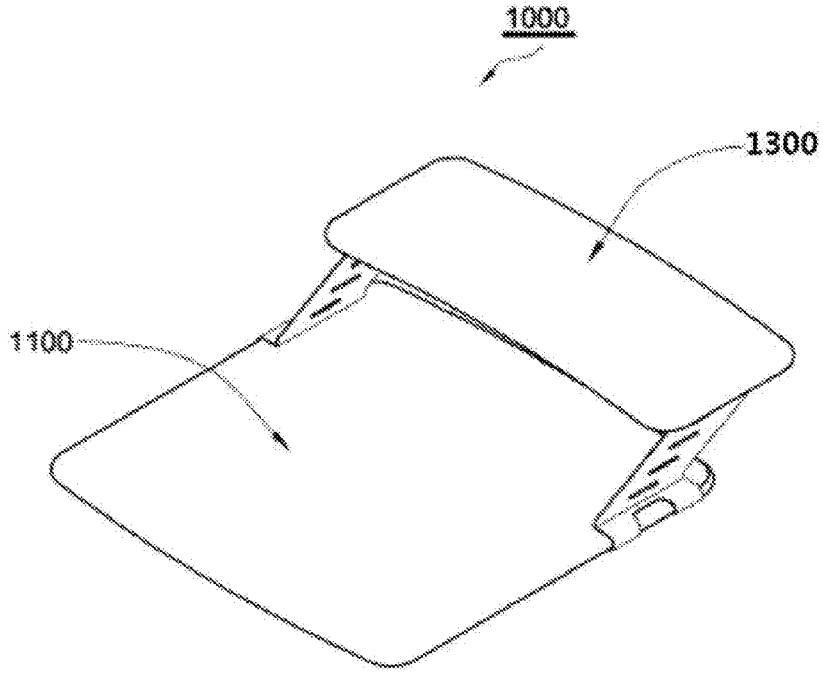
FIG. 3*b* is a perspective view illustrating an upper table of a lift table according to an embodiment of the present in version.
Figure 3C:
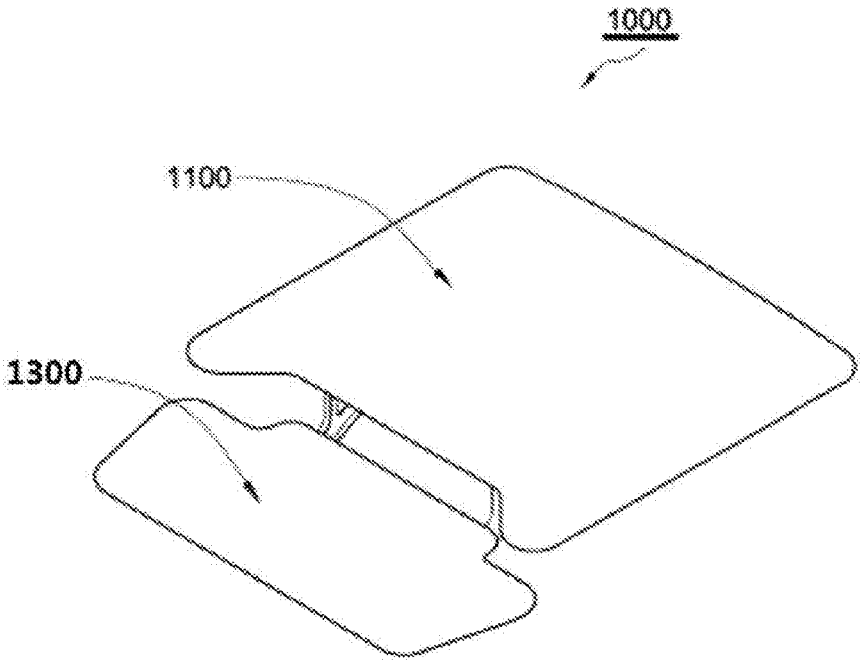
FIG. 3*c* is a perspective view illustrating an upper table of a lift table according to an embodiment of the present invention.
Figure 3D:
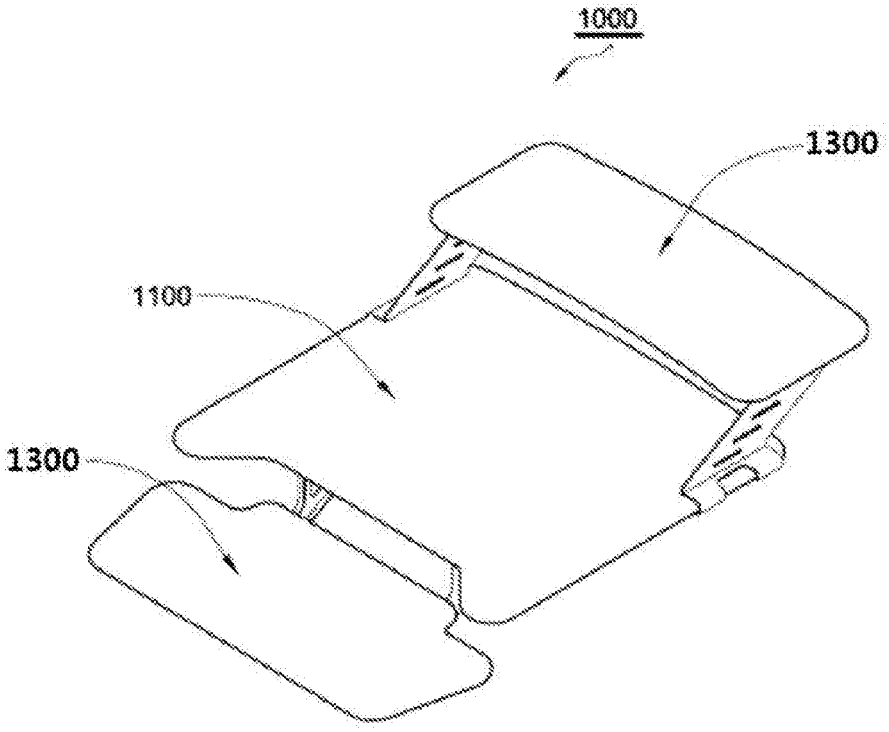
FIG. 3*d* is a perspective view illustrating an upper table of a lift table according to an embodiment of the present invention.

FIG. 3*a* is a perspective view illustrating an upper plate of a lift table according to an embodiment of the present invention. FIG. 3*b* is a perspective view illustrating an upper table of a lift table according to an embodiment of the present invention. FIG. 3*c* is a perspective view illustrating an upper table of a lift table according to an embodiment of the present invention. FIG. 3*d* is a perspective view illustrating an upper table of a lift table according to an embodiment of the present invention.

Referring to FIGS. 3*a* to 3*d*, the upper plate 1000 of the lift table may include a main body 1100 coupled to an upper portion of the lift assembly 2000 and shaped as a flat plate and an assistant plate 1300 provided on the main body 1100. The main body 1100 and the assistant plate 1300 may be coupled with each oilier by way of a predetermined couplers, such as, e.g., brackets or steel wires or bars, but not limited thereto. The assistant plate 1300 may be smaller in size than the main body 1100. The assistant plate 1300 may be shaped as substantially a flat, rectangular plate, but without limited in shape thereto. Alternatively, the assistant plate 1300 may be positioned under the main body 1100 as shown in FIG. 3*c*. The main body 1100 and the assistant plate 1300 may be arranged substantially in parallel with each other. Various objects, e.g., a secondary monitor or keyboard, may be placed on the assistant plate 1300. However, the uses of the assistant plate 1300 ate not limited thereto. As shown in FIG. 3*d*, a plurality of assistant plates 1300 may be provided, which are respectively positioned over and under the main body 1100. The assistant plate 1300 may be shaped to fit an object to be placed thereon.

Figure 4A:
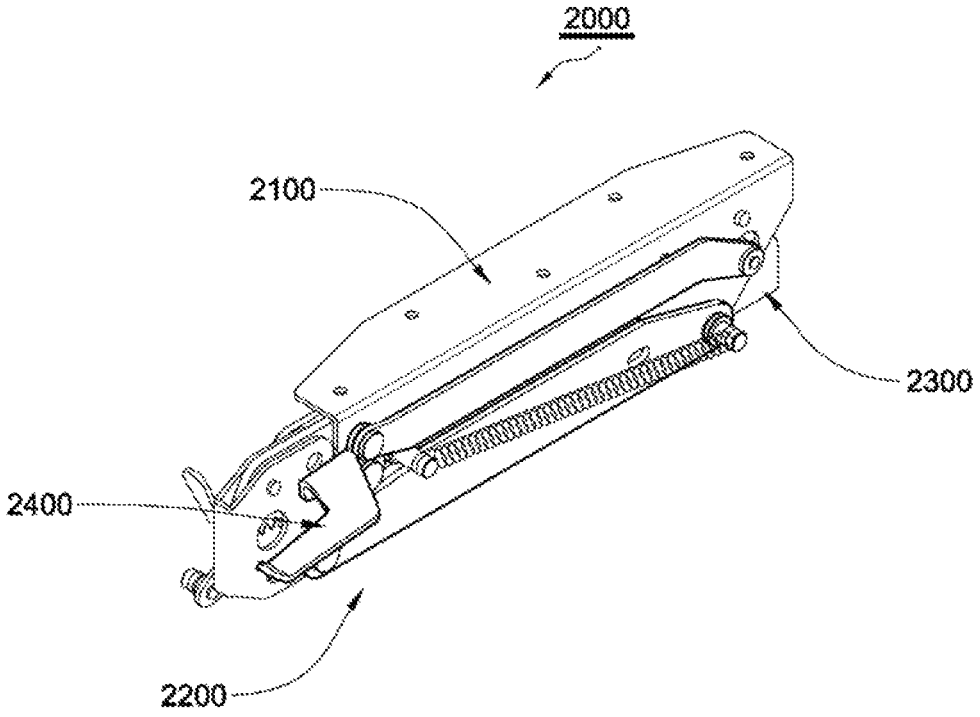
FIG. 4*a* is a perspective view illustrating a lift assembly of a lift table in a folded position according to an embodiment of the present invention.
Figure 4B:
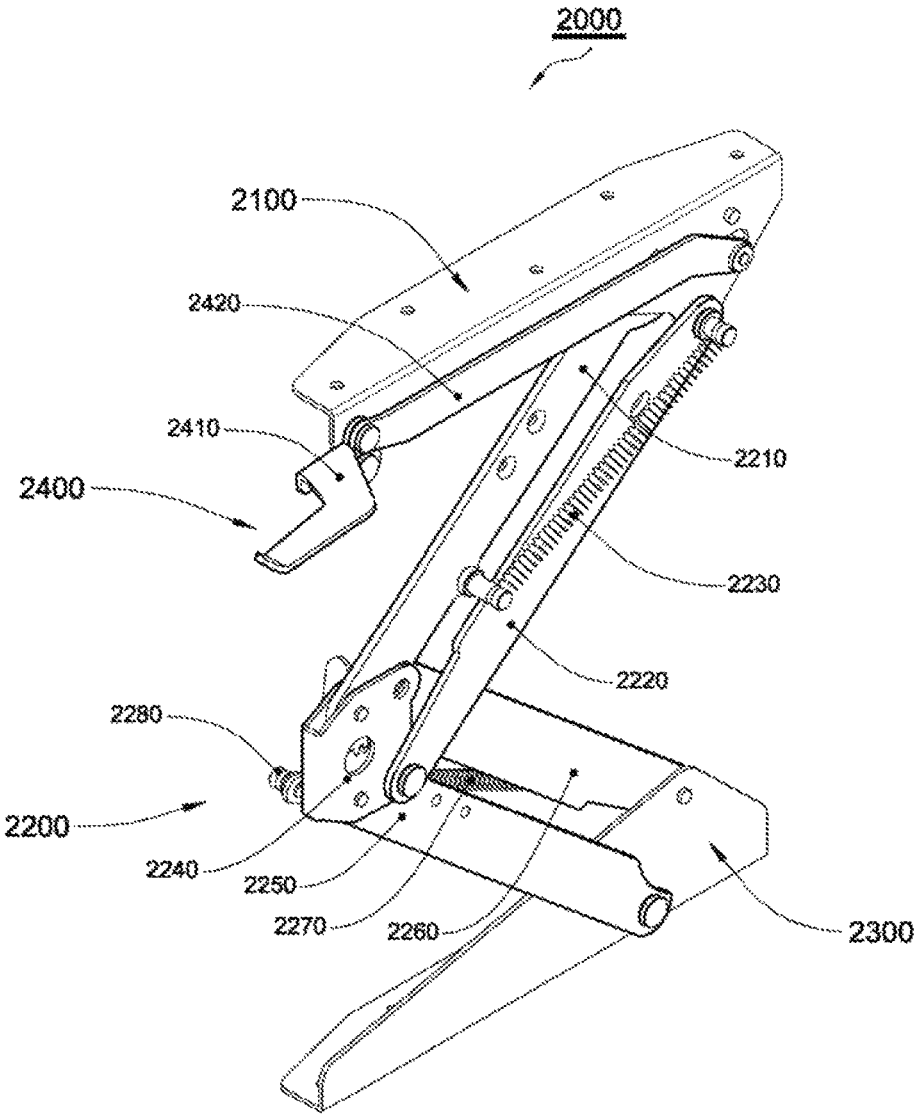
FIG. 4*b* is a perspective view illustrating a lift assembly of a lift table in an unfolded position according to an embodiment of the present invention.
Figure 4C:
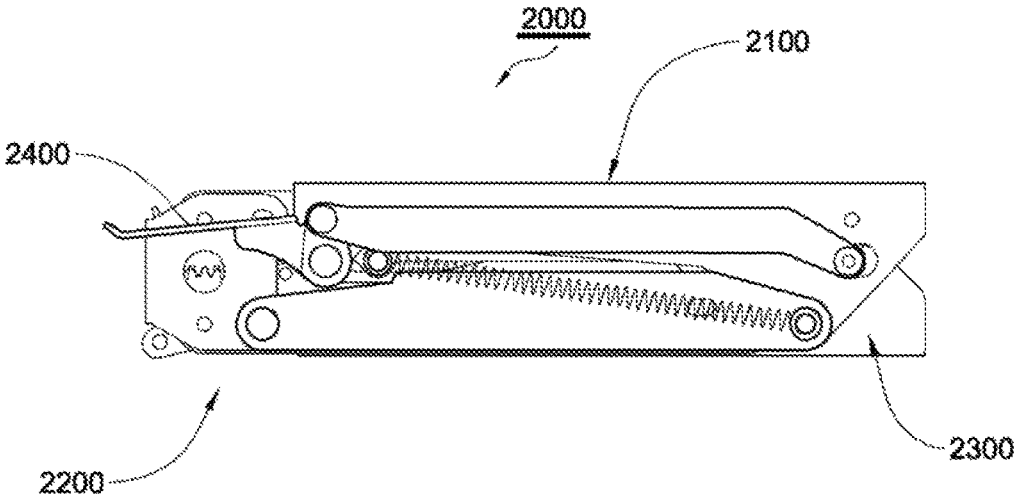
FIG. 4*c* is a side view illustrating a lift assembly of a lift table in a folded position according to an embodiment of the present invention.
Figure 4D:
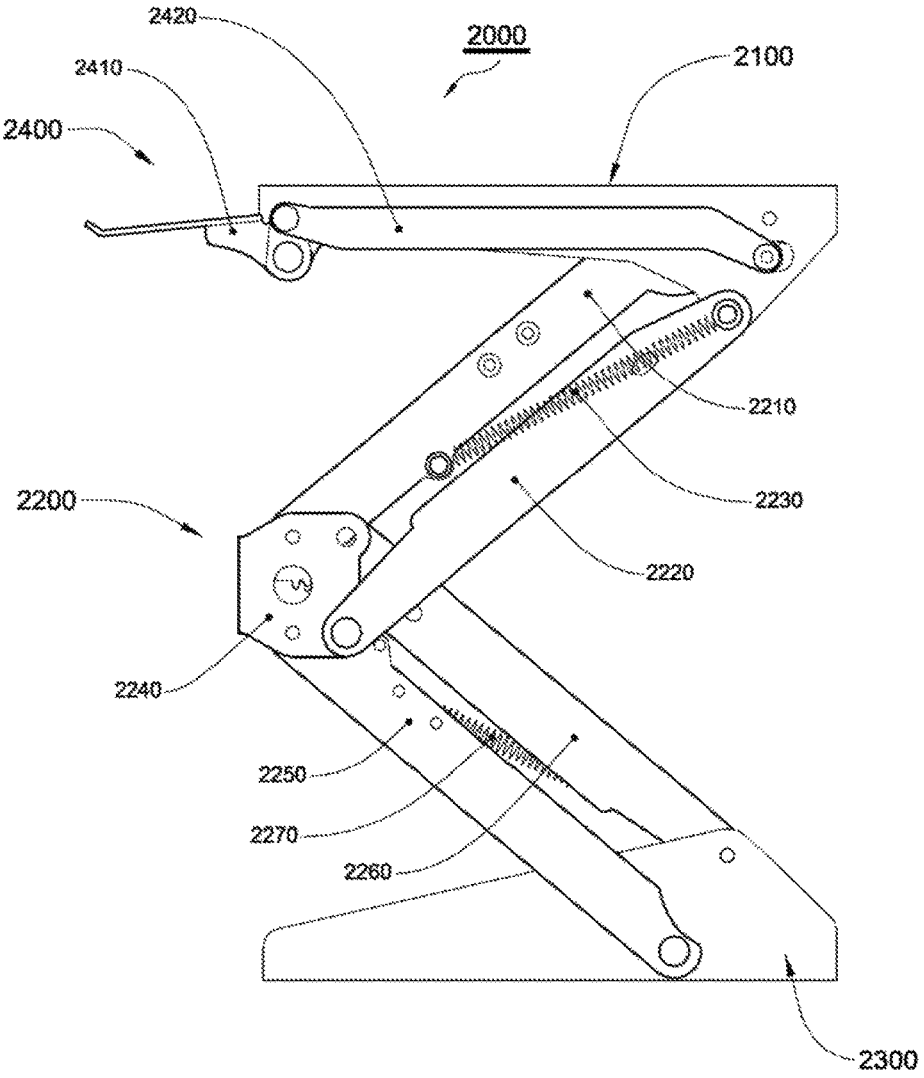
FIG. 4*d* is a side view illustrating a lift assembly of a lift table in an unfolded position according to an embodiment of the present invention.

FIG. 4*a* is a perspective view illustrating a lift assembly of a lift table in a folded position according to an embodiment of the present invention. FIG. 4*b* is a perspective view illustrating a lift assembly of a lift table in an unfolded position according to an embodiment of the present invention. FIG. 4*c* is a side view illustrating a lift assembly of a lift table in a folded position according to an embodiment of the present invention. FIG. 4*d* is a side view illustrating a lift assembly of a lift table in an unfolded position according to an embodiment of the present invention.

Referring to FIGS. 4*a* to 4*d*, the lift assembly 2000 of the lift table may include a driving arm assembly 2200, an upper frame 2100, and a lower frame 2300. The driving arm assembly 2200 may include two pairs of bar-shaped members hinged to each other arid elastic bodies generating an elastic force in a direction along which the bar-shaped members are unfolded or stretched. The driving arm assembly 2200 may be folded or elastically unfolded. The upper frame 2100 is coupled with the upper plate 1000 and is hinged to an end of the driving arm assembly 2200. The lower frame 2300 transfers the load of the upper plate 1000, the upper frame 2100, and the driving arm assembly 2200 to an underside thereof, and the lower frame 2300 is hinged with another end of the driving arm assembly 2200.

The driving arm assembly 2200 may include a bar-shaped upper arm 2210, an assistant upper arm 2220, an upper elastic body 2230, an arm joint 2240, a lower arm 2250, an assistant lower arm 2260, and a lower elastic body 2270.

The upper arm 2210 has an end hinged with the upper frame 2100 and is substantially shaped as a bar. The assistant upper arm 2220 may be bar-shaped and has an end hinged with the upper frame 2300. The assistant upper arm 2220 is positioned in parallel with the upper arm 2210. The upper elastic body 2230 is provided between the upper arm 2210 and the assistant upper arm 2220 to provide an elastic force to the upper arm 2210 and the assistant upper arm 2220 in a direction along which the driving arm assembly 2200 is unfolded or stretched. The arm joint 2240 is shaped as a plate with a hinge hole. The arm joint 2240 is hinged to another end of the upper arm 2210 and another end of the assistant upper arm 2220. The lower arm 2250 is shaped as a bar and has a first end hinged with the arm joint 2240 and a second end hinged with the lower frame 2300. The assistant lower arm 2260 is shaped as a bar and has a first end hinged with the arm joint 2240 and a second end hinged with the lower frame 2300. The assistant lower arm 2260 is disposed in parallel with the lower arm 2250. The lower elastic body 2270 is provided between the lower arm 2250 and the assistant lower arm 2260 and provides an elastic force to the lower arm 2250 and the assistant lower arm 2260 in a direction along which the driving arm assembly 2200 is unfolded or stretched.

The bar-shaped members and the elastic members including the upper frame 2100, the lower frame 2300, the upper arm 2210, the assistant upper arm 2220, the upper elastic body 2230, the lower arm 2250, the assistant lower arm 2260, and the lower elastic body 2270 may be positioned not to overlap one another, at plan view, so that the lift assembly 2000 has a minimized volume or thickness in its folded position and so that the upper plate 1000 of the lift table is minimally spaced apart from the surface on which the lower plate 3000 is placed, thus allowing the components between the upper plate 1000 and the lower plate 3000 to occupy a minimized space. Such structure of the lift assembly 2000 or the lift table allows for more efficient use of space and better outer appearance.

Figure 5A:
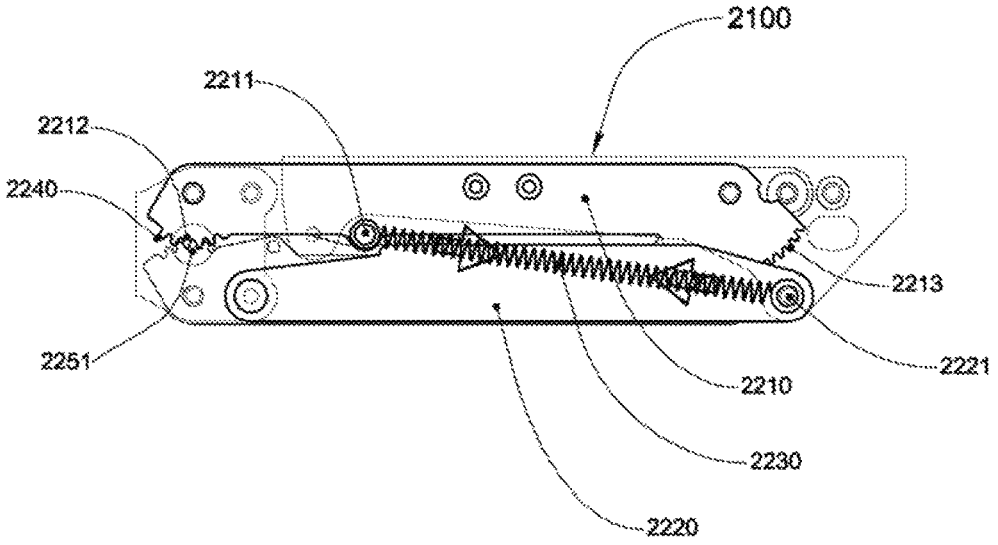
FIG. 5*a* is a side view illustrating an upper arm and an upper assistant arm of a lift table in a folded position according to an embodiment of the present invention.
Figure 5B:
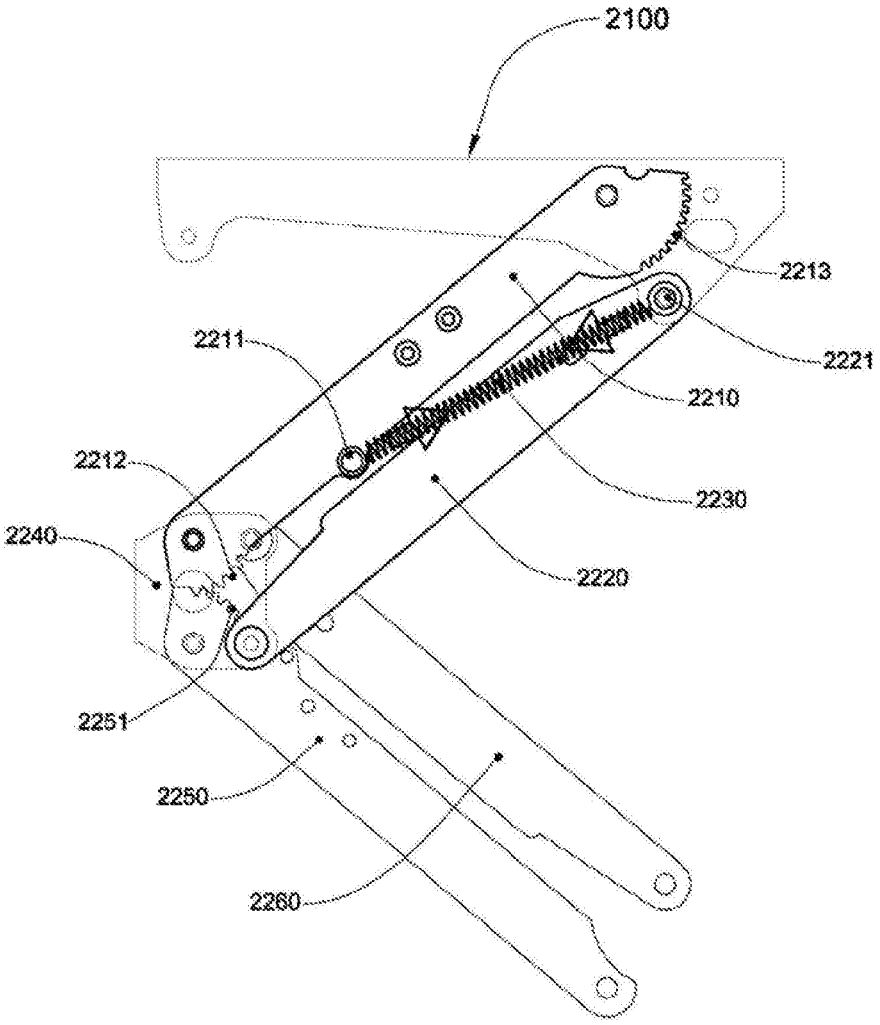
FIG. 5*b* is a side view illustrating an upper arm and an upper assistant arm of a lift table in an unfolded position according to an embodiment of the present invention.

FIG. 5*a* is a side view illustrating an upper arm and an upper assistant arm of a lift table in a folded position according to an embodiment of the present invention. FIG. 5*b* is a side view illustrating an upper arm and an upper assistant arm of a lift table in an unfolded position according to an embodiment of the present invention.

Referring to FIGS. 5*a* and 5*b*, the driving arm assembly 2200 of the lift table includes the upper arm 2210, the assistant upper arm 2220, the upper elastic body 2230, and the arm joint 2240.

The respective first ends of the upper arm 2210 and the assistant upper arm 2220 are hinged to the upper frame 2100, and the respective second ends of the upper arm 2210 and the display unit 220 are hinged to the arm joint 2240. Thus, the form or shape at which the upper arm 2210, the assistant upper arm 2220, the upper elastic body 2230, and the arm joint 2240 may be changed, with the upper arm 2210 and the assistant upper arm 2220 remaining parallel with each other while the upper frame 2100 and the arm joint 2240 are left parallel with each other.

An end of the upper arm 2210 may have a first upper hanging protrusion 2211 to which an end of the upper elastic body 2230 may be connected, and an end of the assistant upper arm 2220 may have a second upper hanging protrusion 2221 to which another end of the upper elastic body 2230 may be connected. The upper elastic body 2230 may provide an elastic force to the upper arm 2210 and the assistant upper arm 2220 in a direction along which the driving arm assembly 2200 is unfolded or stretched, allowing the driving arm assembly 2200 to be automatically unfolded, stretched, or expanded unless there are other external forces or friction.

The end of the upper arm 2210, which is hinged to the upper frame 2100, may include a first locking gear 2213 having cut teeth.

The first locking gear 2213 may operate along with the locking device 2400 to secure the upper arm 2210 against movement or rotation. A detailed description of the configuration and operation of the first locking gear 2213 and the 2400 is given below with reference to FIGS. 8*a* and 8*b*.

Figure 6A:
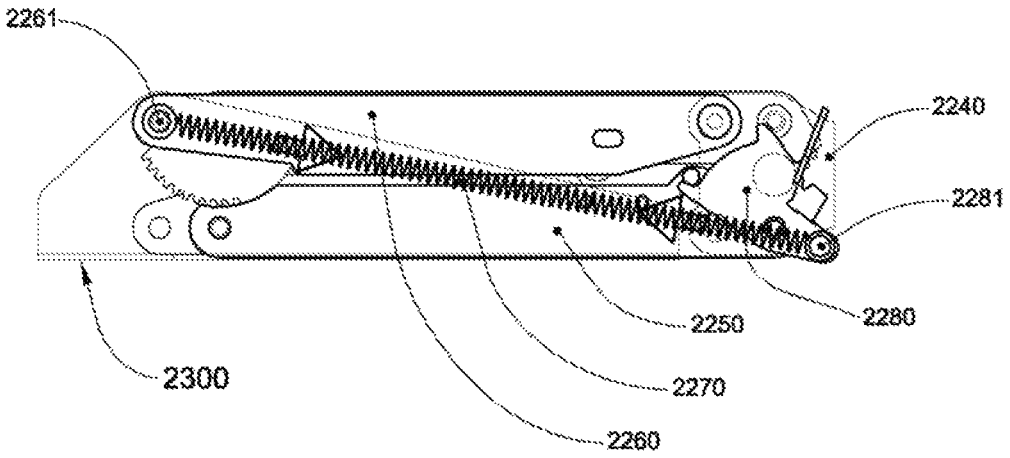
FIG. 6*a* is a side view illustrating a lower arm and a lower assistant arm of a lift table in a folded position according to an embodiment of the present invention.
Figure 6B:
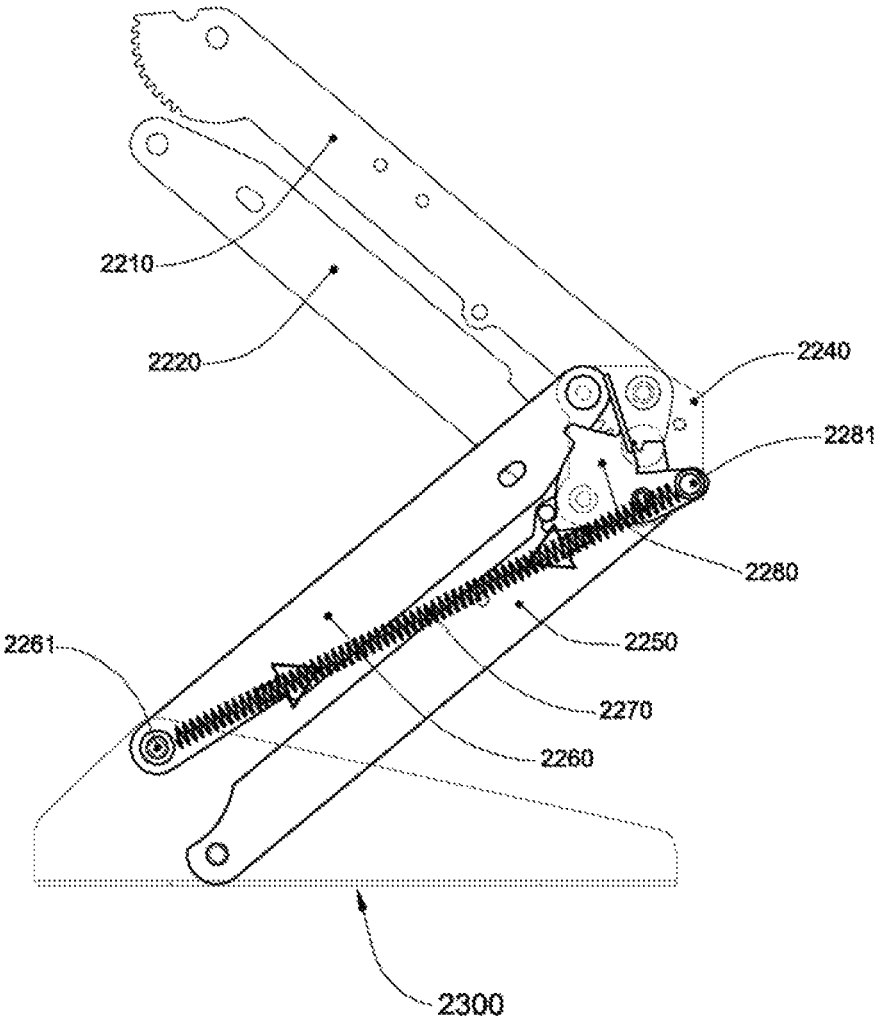
FIG. 6*b* is a side view illustrating a lower arm and a lower assistant arm of a lift table in an unfolded position according to an embodiment of the present invention.
Figure 6C:
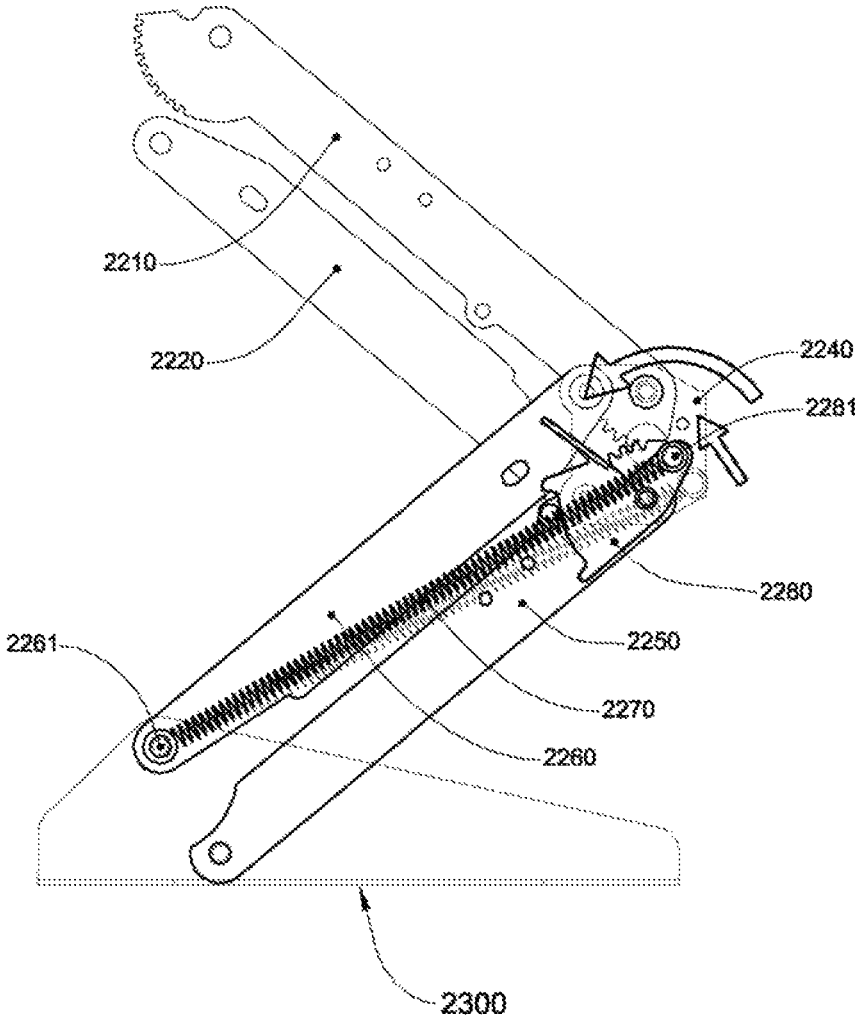
FIG. 6*c* is a side view illustrating a lift table wherein an elasticity adjusting lever is manipulated according to an embodiment of the present invention.

FIG. 6*a* is a side view illustrating a lower arm and a lower assistant arm of a lift table in a folded position according to an embodiment of the present invention. FIG. 6*b* is a side view illustrating a lower arm and a lower assistant arm of a lift table in an unfolded position according to an embodiment of the present invention. FIG. 6*c* is a side view illustrating a lift table wherein an elastically adjusting lever is manipulated according to an embodiment of the present invention.

Referring to FIGS. 6*a* and 6*b*, the driving arm assembly 2200 of the lift table may include the lower arm 2250, the assistant lower arm 2250, the lower elastic body 2270, and the arm joint 2240, Referring to FIG. 6*c*, the lower arm 2250 of the lift table may include a first lower hanging protrusion 2281 where the lower elastic body 2270 is connected with the lower arm 2250 and an elasticity adjusting lever 2280 hinged to a side of an end of the arm joint 2240 of the lower arm 2250 and rotated at a predetermined angle to change the position where the lower elastic body 2270 is connected to the lower arm 2250.

The respective first ends of the lower arm 2250 and the assistant lower arm 2260 are hinged to the lower frame 2300, and the respective second ends of the lower arm 2250 and the assistant lower arm 2260 are hinged to the arm joint 2240. Thus, the form or shape at which the lower arm 2250, the assistant lower arm 2260, the lower elastic body 2270, and fee arm joint 2240 are coupled may be changed with the lower arm 2250 and the assistant lower arm 2260 left parallel with each other while the lower frame 2300 and the arm joint 2240 remain parallel with each other. The elasticity adjusting lever 2280 may include a first lower hanging protrusion 2281 to which an end of the lower elastic body 2270 is connected, and an end of the assistant lower arm 2260 may include a second lower hanging protrusion 2261 to which another end of the lower elastic body 2270 may be connected. The lower elastic body 2270 provides an elastic force to the lower arm 2250 and the assistant lower arm 2260 in a direction along which the driving arm assembly 2200 is unfolded or stretched, allowing for autonomous unfolding or expansion of the driving arm assembly 2200 unless there are other external forces or friction.

The strength of an elastic force applied to the lower arm 2250 and the assistant lower arm 2260 in a direction where the driving arm assembly 2200 is unfolded may be adjusted by the elasticity adjusting lever 2280. The elasticity adjusting lever 2280 may change the position where the lower elastic body 2270 is connected with the lower arm 2250. Although there is no change in the elastic force from the lower elastic body 2270, the strength of an actual elastic force applied to the lower arm 2250 and the assistant lower arm 2260 may be changed as the direction or angle of elastic force applied to the lower arm 2250 and the assistant lower arm 2260 varies. Thus, the strength of elastic force applied to the driving arm assembly 2200 may be adjusted, allowing for adjustment of the strength of the elastic force unfolding or stretching the lift assembly 2000. Thus, an elastic force required for expanding or unfolding the lift table may be adjusted depending on the load placed on the upper plate 1000. When an object loaded on the upper plate 1000 is relatively lightweight, the elasticity adjusting lever 2280 may be positioned as shown in FIG. 6*b*, and when the object is relatively heavy, the elasticity adjusting lever 2280 may be positioned as shown in FIG. 6*c*.

Figure 7A:
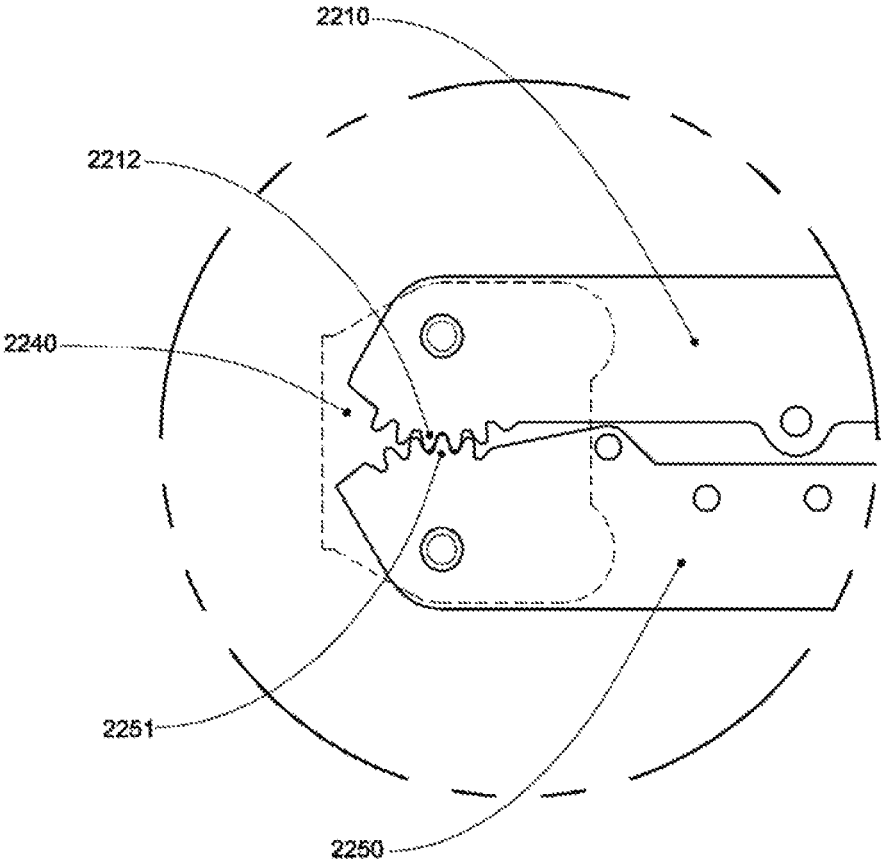
FIG. 7*a* is a view illustrating an example in which an upper joint gear is engaged with a lower joint gear in a lift table according to an embodiment of the present invention.
Figure 7B:
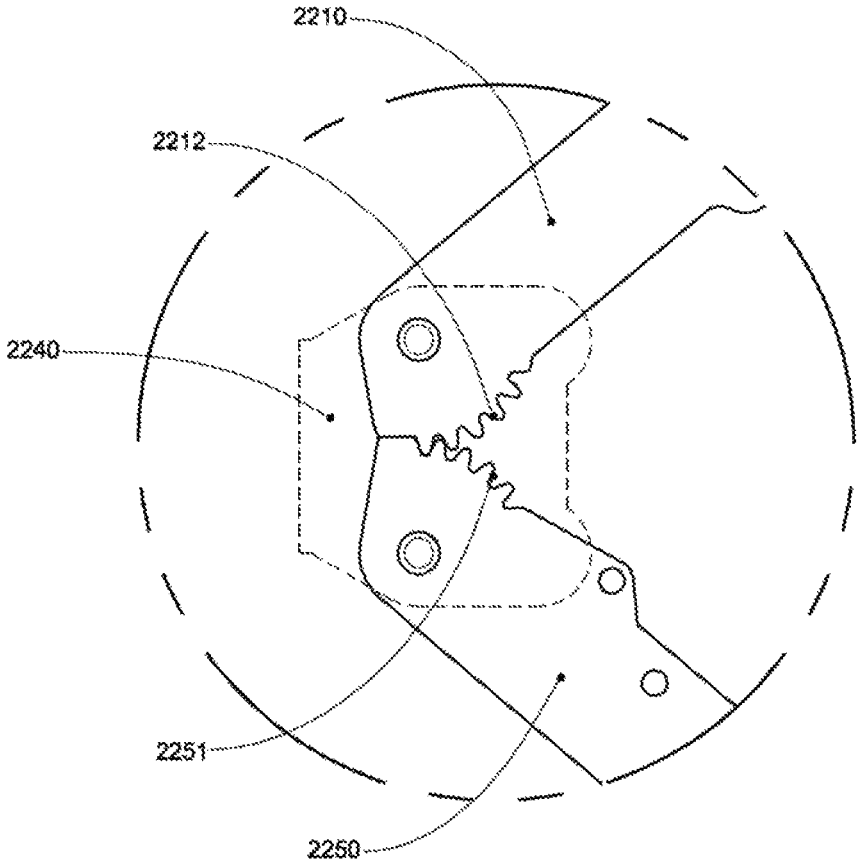
FIG. 7*b* is a view illustrating an example in which an upper joint gear is disengaged with a lower joint gear in a lift table according to an embodiment of the present invention.

FIG. 7*a* is a view illustrating an example in which an upper joint gear is engaged with a lower joint gear in a lift table according to an embodiment of the present invention. FIG. 7*b* is a view illustrating an example in which an upper joint gear is disengaged with a lower joint gear in a lift table according to an embodiment of the present invention.

Referring to FIGS. 7*a* and 7*b*, the upper arm 2210 of the lift table may include an upper joint gear 2212 at an end thereof which is positioned near the arm joint 2240. The lower arm 2250 of the lift table may include a lower joint gear 2251 at an end thereof which is positioned near the arm joint 2240, corresponding to the upper joint gear 2212.

Thus, the form or shape at which the upper arm 2210, the assistant upper arm 2220, the upper elastic body 2230, and the arm joint 2240 may be changed, with the upper arm 2210 and the assistant upper arm 2220 remaining parallel with each other while the upper frame 2100 and the arm joint 2240 are left parallel with each other, as described above in connection with FIGS. 5*a* and 5*b*, and the form or shape at which the lower arm 2250, the assistant lower arm 2260, the lower elastic body 2270, and the arm joint 2240 are coupled may be changed with the lower arm 2250 and the assistant lower arm 2260 left parallel with each other while the lower frame 2300 arid the arm joint 2240 remain parallel with each other, as described above in connection with FIGS. 6*a* and 6*b*. Such change in the coupled form or shape may be made by an elastic force from the upper elastic body 2230 or the lower elastic body 2270 or an external force applied to the lift table by the user. The elastic force by She upper elastic body 2230 and the lower elastic body 2270 and the external force by the user may he relatively less applied to the arm joint 2240. The upper arm 2210 and the tower arm 2250, unless at the same angle with respect to the arm joint 2240, may lose parallelity, and thus, the upper plate 1000 and the lower plate 3000 may have difficulty in remaining parallel, deteriorating the convenience or usability of the lift table. The upper joint gear 2212 and the lower joint gear 2251 may restrict the upper arm 2210 and the lower arm 2250 to stretch or unfold at the same angle with respect to the lower arm 2250 and the arm joint 2240, allowing the parallelity to be maintained for all of the components or members or between the upper plate 1000 and the lower plate 3000.

Figure 8A:
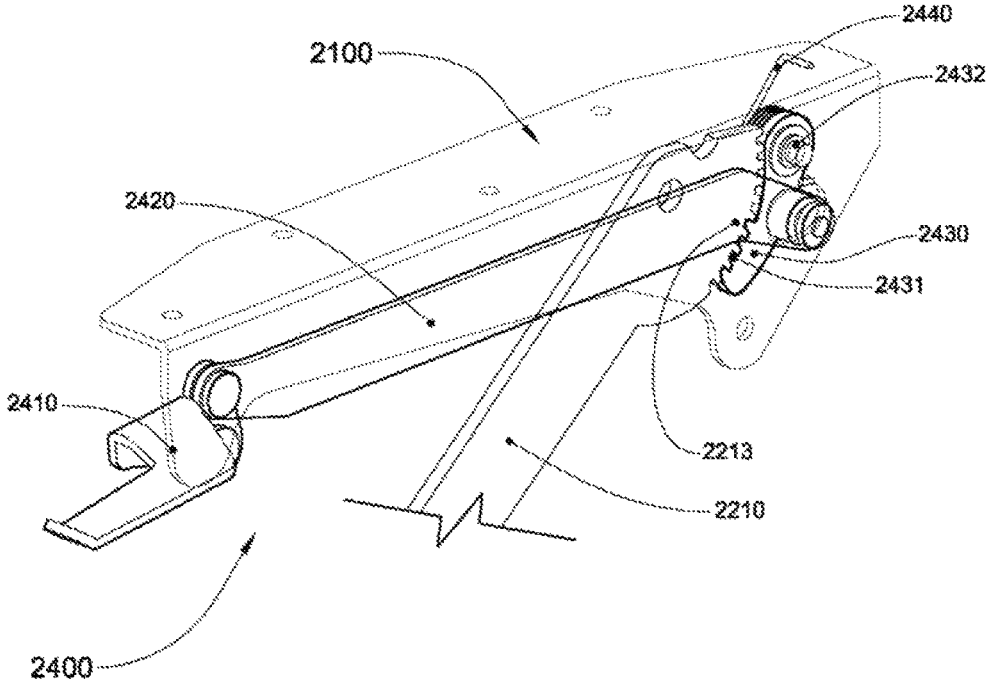
FIG. 8*a* is a view illustrating an example in which a lift table is locked by a locking device according to an embodiment of the present invention.
Figure 8B:
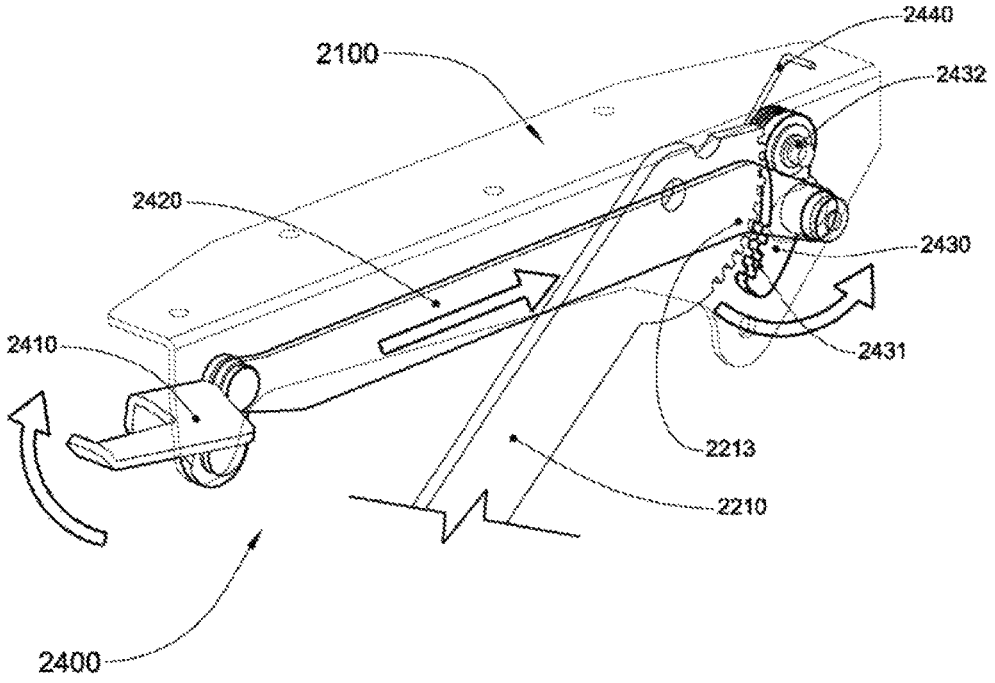
FIG. 8*b* is a view illustrating an example in which a lift table is unlocked by a locking device according to an embodiment of the present invention.

FIG. 8*a* is a view illustrating an example in which a lift table is locked by a locking device according to an embodiment of the present invention. FIG. 8*b* is a view illustrating an example in which a lift table is unlocked by a locking device according to an embodiment of the present invention.

Referring to FIGS. 8*a* and 8*b*, the locking device 2400 of the lift table may include a locking latch 2430, a locking elastic body 2440, a locking driving arm 2420, and a locking lever 2410.

The locking latch 2430 may include a second locking gear 2431 corresponding to the first locking gear 2213 and a looking hinge 2432 hinged to a side surface of the upper frame 2100 to enable a rotational movement allowing the first locking gear 2213 and the second locking gear 2431 to be engaged or disengaged from each other. The locking elastic body 2440 may provide an elastic force to the locking latch 2430 in a direction along which the first locking gear 2213 and the second locking gear 2431 are engaged with each other. The locking driving arm 2420 is shaped as a bar and having an end hinged to a side surface of the locking latch 2430 to allow the first locking gear 2213 and the second locking gear 2431 to be disengaged from each other when receiving an external force. The locking lever 2410 may allow an external force to manually be applied to the locking driving arm 2420.

As set forth above in connection with FIGS. 2*a* to 2*d*, the locking device 2400 may secure the position of the lift assembly 2000 or release the secured position of the lift assembly 2000 through manipulation of the locking lever 2410. Accordingly, when the locking lever 2410 is manipulated with the lift table in the folded position, the lift assembly 2000 may be automatically or elastically unfolded or stretched, and when an external force is applied to the upper plate 1000 in a lower direction while the locking lever 2410 is in the manipulated position, the lift assembly 2000 is folded.

For example, the second locking gear 2431 of the locking latch 2430 may he engaged with the first locking gear 2213 by the locking elastic body 2440 to secure the position of the upper arm 2210, and when an external force is applied to the locking lever 2410, the locking driving arm 2420 may be moved in a straight direction or translated to rotate the locking latch 2430 so that the second locking gear 2431 maybe disengaged from the first locking gear 2213.

When the position of the upper arm 2210 is secured by the first locking gear 2213 and the second locking gear 2431 of the locking latch 2430, the structure including the upper arm 2210, the assistant upper arm 2220, the arm joint 2240, and the upper frame 2100 may be secured, and the structure including the lower arm 2250, the assistant lower arm 2260, the arm joint 2240, and the lower frame 2300 is also secured. Once one of the hinged portions in the structures of the lift table is secured in a particular position, the overall structure or each hinge in the lift table may be secured.

Thus, the folded or unfolded position of the lift assembly 2000 may be easily secured by the locking device 2400.

According to an embodiment of the present invention, there may be provided a plurality of lift assemblies 2000, and each of the lift assemblies 2000 may have a locking device 2400. In this case, tire respective locking levers 2410 of the locking devices 2400 respectively provided in the lift assemblies 2000 may simultaneously be manipulated to perform locking or unlocking substantially at the same time to thereby enable a vertical movement of the upper plate 1000 of the lift table, e.g., for safety in use of the lift table. Each of the locking devices 2400 may be operated (e.g., locking or unlocking) separately or independently from the other locking devices 2400 so that the locking or unlocking of the locking devices 2400 may be achieved only when the plurality of locking levers 2410 are simultaneously manipulated, thus preventing any dangerous situation that may occur if only one locking device is provided for multiple lift assemblies 2000 or the respective locking devices of the lift assemblies 2000 are interoperated with one another.

Figure 9A:
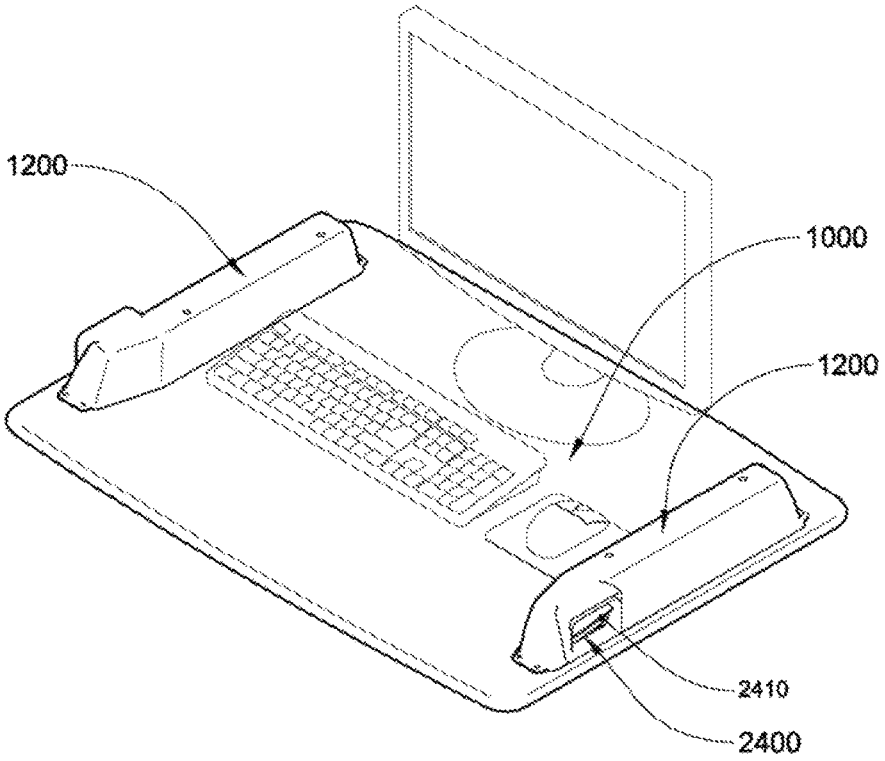
FIG. 9*a* is a perspective view illustrating a lift table in a folded position according to an embodiment of the present invention.
Figure 9B:
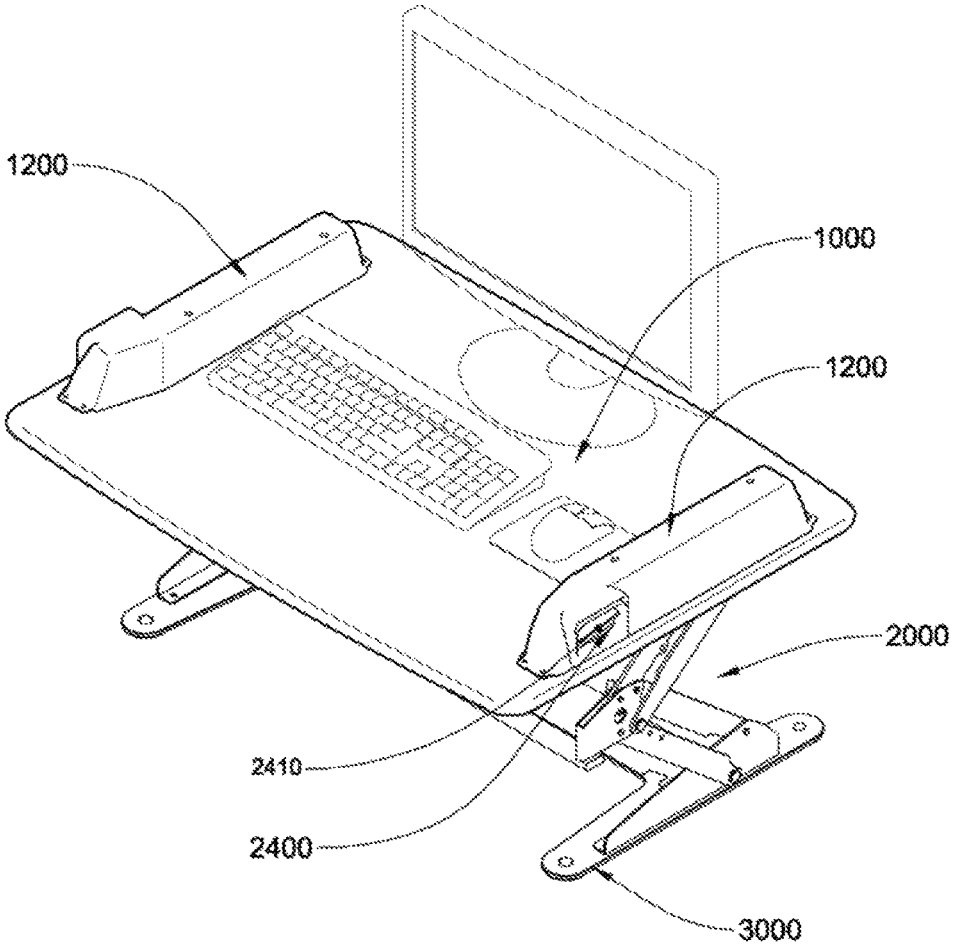
FIG. 9*b* is a perspective view illustrating a lift table in an unfolded position according to an embodiment of the present invention.
Figure 9C:
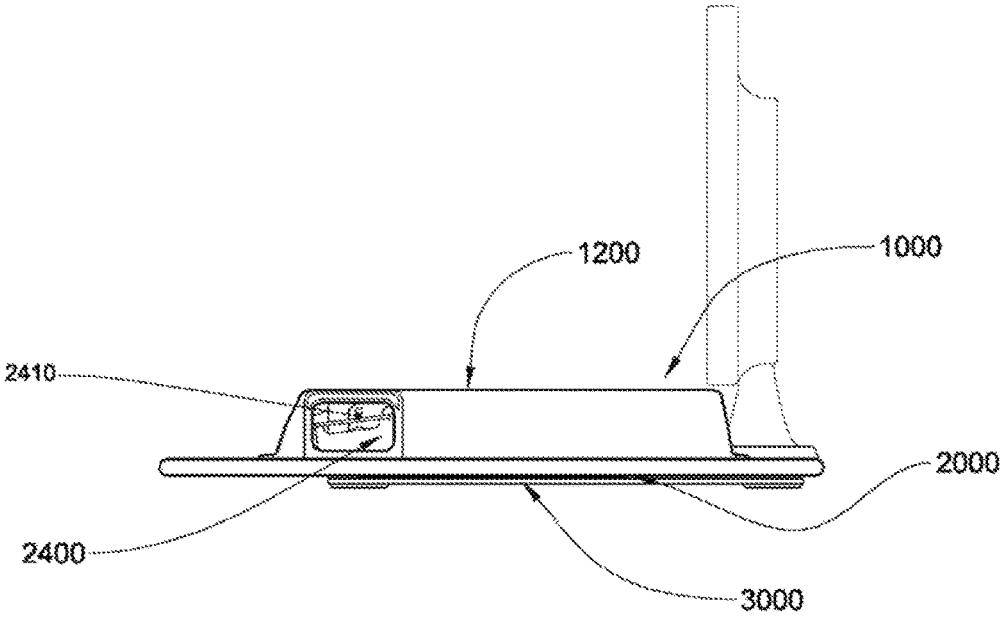
FIG. 9*c* is a side view illustrating a lift table in a folded position according to an embodiment of the present invention.
Figure 9D:
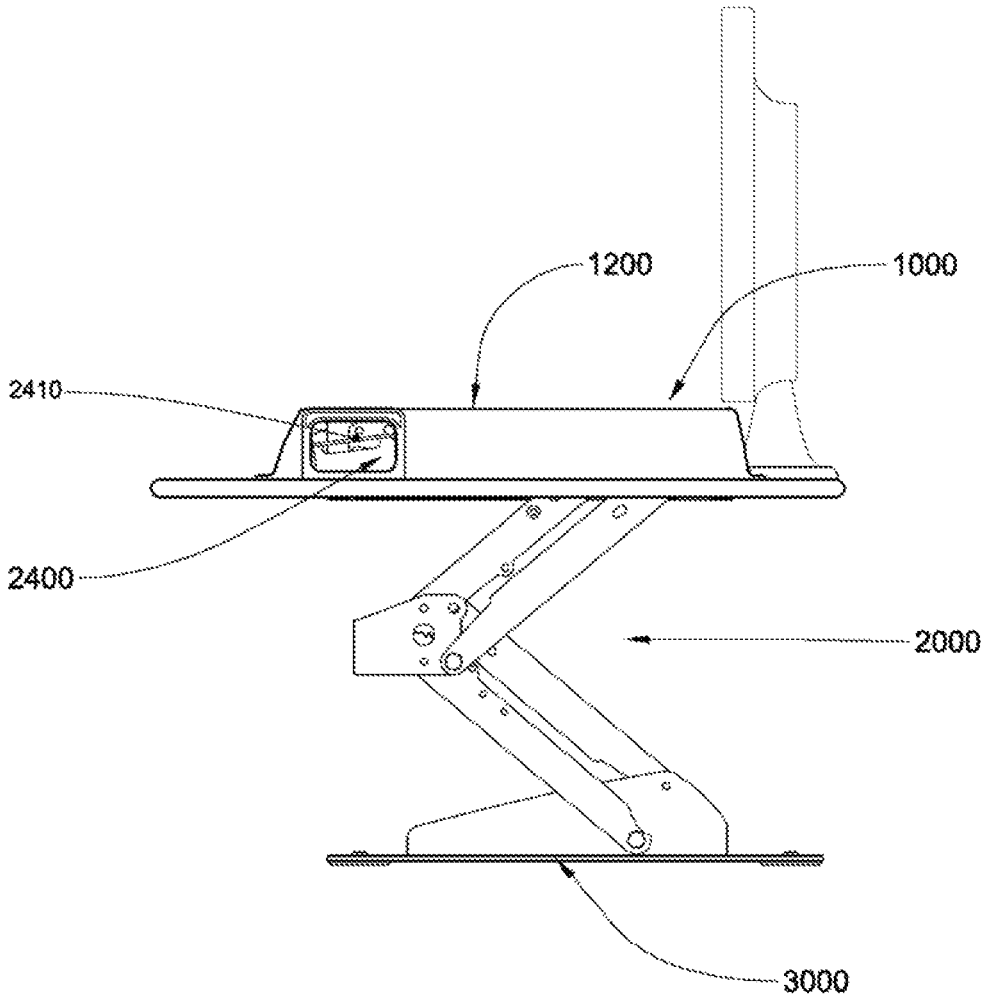
FIG. 9*d* is a side view illustrating a lift table in an unfolded position according to an embodiment of the present invention.
Figure 10A:
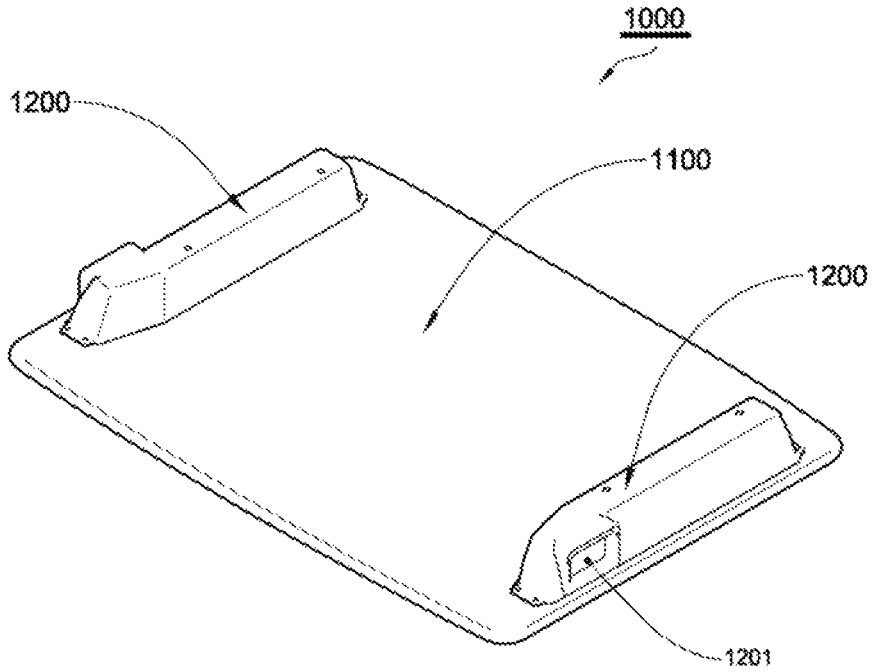
FIG. 10*a* is a perspective view illustrating an upper table of a lift table according to an embodiment of the present invention.
Figure 10B:
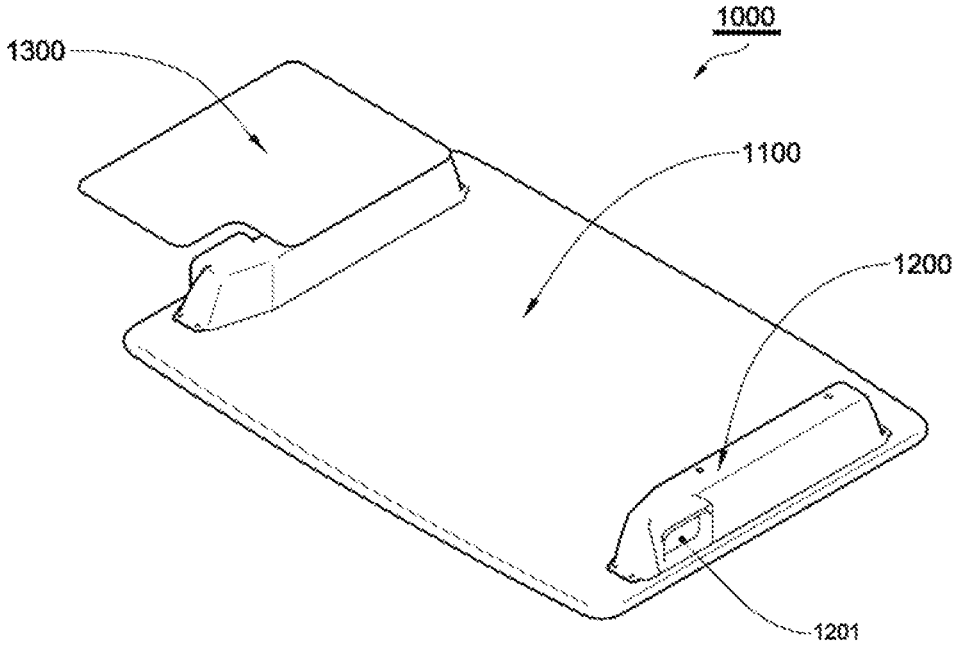
FIG. 10*b* is a perspective view illustrating as upper table of a lift table according to an embodiment of the present invention.

FIG. 9*a* is a perspective view illustrating a lift table in a folded position according to an embodiment of the present invention. FIG. 9*b* is a perspective view illustrating a lift table in an unfolded position according to an embodiment of the present invention. FIG. 9*c* is a side view illustrating a lift table in a folded position according to an embodiment of the present invention. FIG. 9*d* is a side view illustrating a lift table in an unfolded position according to an embodiment of the present invention. FIG. 10*a* is a perspective view illustrating an upper table of a lift table according to an embodiment of the present invention. FIG. 10*b* is a perspective view illustrating an upper table of a lift table according to an embodiment of the present invention.

For the same or similar components or elements to those shown in FIGS. 3 to 8*b*, the description of the components or elements of FIGS. 3 to 8*b* applies, and no further detailed description is given below, focusing primarily on the differences.

The upper plate 1000 of the lift table may include a main body 1100, receivers 1200, and an assistant plate 1300. The main body 1100 is shaped as a flat plate and allows an object to be placed thereon. The upper frame 2100 of the lift assembly 2000 may be coupled to a lower portion, e.g., the bottom, of each receiver 1200. Each receiver 1200 may have an upper portion protruding upward of the main body 1100 and a lower depressed portion. The folded lift assembly 2000 and locking device 2400 may be received in the receiver 1200. The assistant plate 1300 may be provided at an edge of the main body 1100 over the main body 1100.

An opening 1201 may be formed in a side of the upper protruding portion of the receiver 1200 to allow for manipulation and release of the locking device 2400.

As such, the lift assembly 2000 and the locking device 2400, in the folded position of the lift assembly 2000, may be received in its corresponding receiver 1200, and thus, the upper plate 1000 of the lift table may be positioned as close to the surface on which the lift table is placed as possible. Thus, the lift table allows for more efficient use of space and better appearance.

The lift assembly 2000 and the locking device 2400 may be fully received and positioned inside the hollow space of the receiver 1200, and in this position, the locking device 2400, e.g., the locking lever 2410 of the locking device 2400, may be viewed from outside through the opening 1201, allowing the user to manipulate the locking lever 2410 through the opening 1201.

According to an embodiment of the present invention, a pair of lift assemblies 2000 may be provided, and a pair of receivers 1200 respectively corresponding to the lift assemblies 2000 may be provided. In this case, the assistant plate 1300 may be connected to one of the two receivers 1200 as shown in FIG. 10*b*.

While the inventive concept has been shown and described with reference to exemplary embodiments thereof, it will be apparent to those of ordinary skill in the art that various changes in form and detail may be made thereto without departing from the spirit and scope of the inventive concept as defined by the following claims.

What is claimed is:

1. A lift table, comprising:

an upper plate;

a lower plate;

a lift assembly provided between the upper plate and the lower plate and including an upper frame hinged to the upper plate, a lower frame hinged to the lower plate, and a driving arm assembly, wherein the driving arm assembly includes two upper arms connected with each other via a first elastic body, and two lower arms connected with each other via a second elastic body, the upper arms being hinged to the lower arms;

a locking device provided at an end of the driving arm assembly to secure a folded or unfolded position of the driving arm assembly; and a receiver protruding on the upper plate and having an inner hollow space where the lift assembly and the locking device are received while the lift assembly is in a folded position.

2. The lift table of claim 1, wherein the upper table includes a main body shaped as a flat plate and one or more assistant plates connected with the main body and spaced apart from the main body at a predetermined distance.

3. The lift table of claim 1, wherein the receiver includes an opening through which the locking device can be manipulated.

4. The lift table of claim 1, wherein the driving arm assembly further includes an arm joint, wherein the two upper arms are disposed parallel with each other, respective first ends of the two upper arms being hinged to the upper frame, and respective second ends of the two upper arms being hinged to the arm joint, and wherein the two lower arms are disposed parallel with each other, respective first ends of the two lower arms being hinged to the arm joint, and respective second ends of the two lower arms being hinged to the lower frame.

5. The lift table of claim 4, wherein the first elastic body provides an elastic force to the two upper arms in a direction along which the driving arm assembly is unfolded, and the second elastic body provides an elastic force to the two lower arms in the direction.

6. The lift table of claim 1, wherein at least one of the first elastic body or the second elastic body includes a spring.

7. A lift table, comprising:

an upper plate;

a lower plate;

a lift assembly provided between the upper plate and the lower plate and including an upper frame hinged to the upper plate, a lower frame hinged to the lower plate, and a driving arm assembly, wherein the driving arm assembly includes two upper arms connected with each other via a first elastic body, two lower arms connected with each other via a second elastic body, the upper arms hinged to the lower arms; and a locking device provided at an end of the driving arm assembly to secure a folded or unfolded position of the driving arm assembly, wherein a first upper arm of the two upper arms includes a first locking gear at a first end thereof.

8. The lift table of claim 7, wherein the locking device includes:

a locking latch, the locking latch including a second locking gear corresponding to the first locking gear and a locking hinge hinged to a side surface of the upper frame to create a rotational movement allowing the first locking gear and the second locking gear to be engaged or disengaged from each other;

a locking elastic body applying an elastic force to the locking latch in a direction along which the first locking gear and the second locking gear are engaged with each other;

a bar-shaped locking driving arm having a first end hinged to a side surface of the locking latch to space the first locking gear apart from the second locking gear when an external device is applied to a second end of the locking driving arm; and a locking lever allowing the external force to be manually applied to the second end of the locking driving arm.

9. The lift table of claim 8, wherein the first upper arm includes an upper joint gear at a second end thereof, and a first lower arm of the two lower arms includes a lower joint gear at a first end of thereof, the lower joint gear corresponding to the upper joint gear.

10. The lift table of claim 9, wherein the first lower arm includes an elasticity adjusting lever hinged to the first end of the first lower arm and rotated at a predetermined angle to change a position where the second elastic body is connected to the first lower arm.

* * * * *